US007131428B2

(12) United States Patent
Ricco et al.

(10) Patent No.: US 7,131,428 B2
(45) Date of Patent: Nov. 7, 2006

(54) METHOD FOR CONTROLLING FUEL INJECTION IN AN INTERNAL-COMBUSTION ENGINE

(75) Inventors: Mario Ricco, S.P. Casamassima km3 (IT); Sisto Luigi De Matthaeis, S.P. Casamassima km3 (IT); Antonio Gravina, S.P. Casamassima km3 (IT); Sergio Stucchi, S.P. Casamassima km3 (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 11/109,789

(22) Filed: Apr. 20, 2005

(65) Prior Publication Data

US 2006/0102154 A1 May 18, 2006

(30) Foreign Application Priority Data

Nov. 12, 2004 (EP) ..... 04425841

(51) Int. Cl.
*F02M 51/00* (2006.01)

(52) U.S. Cl. ..... 123/478; 123/480; 361/152

(58) Field of Classification Search ..... 123/478, 123/480, 490; 361/152, 154, 155
See application file for complete search history.

(56) References Cited

U.S. PATENT DOCUMENTS 4,688,536 A * 8/1987 Mitsuyasu et al. ..... 123/490
4,732,129 A * 3/1988 Takigawa et al. ..... 123/478
4,958,610 A * 9/1990 Yamamoto et al. ..... 123/478
6,059,204 A 5/2000 Augustin
6,415,762 B1 7/2002 Hafner et al.

FOREIGN PATENT DOCUMENTS

| | | |
|---|---|---|
| EP | 0 570 986 A | 11/1993 |
| FR | 2 761 113 A | 9/1998 |
| JP | 11 200932 A | 7/1999 |

* cited by examiner

*Primary Examiner*—John T. Kwon
(74) *Attorney, Agent, or Firm*—Crowell & Moring LLP

(57) ABSTRACT

A method is provided for controlling fuel injection in an internal-combustion engine provided with an electroinjector, including an electroactuator, an injection nozzle, and a pin, which is movable along an opening stroke and a closing stroke for opening/closing the nozzle under the control of the electroactuator and according to the supply pressure of the fuel into the electroinjector. The method supplies to the electroactuator a first electrical command and at least a second electrical command, which are sufficiently close to one another as to displace the pin with a profile of motion without any discontinuity in time, and such as to cause the pin to perform a first opening displacement and, respectively, a second opening displacement. Between one injection and the next, at least one among the following quantities is varied as a function of operating parameters of the engine: duration of at least one among the electrical commands; number of the electrical commands; and distance in time between the electrical commands.

15 Claims, 4 Drawing Sheets

METHOD FOR CONTROLLING FUEL INJECTION IN AN INTERNAL-COMBUSTION ENGINE

CROSS-REFERENCE TO RELATED APPLICATIONS

This application claims the priority of European Application No. 04425841.6, filed Nov. 12, 2004, the disclosure of which is expressly incorporated by reference herein.

BACKGROUND AND SUMMARY OF THE INVENTION

The present invention relates to a method for controlling fuel injection in an internal-combustion engine.

In the engine sector, there is felt the need to make injections of fuel in which the instantaneous flow rate of injected fuel as a function of time comprises at least two stretches with levels that are substantially constant and different from one another, i.e., it can be represented schematically by a curve of the "stepwise" type. In particular, there is felt the need to inject an instantaneous flow of fuel having a plot in time T similar to the one represented by the curve of FIG. 1, in which there is present a first level L1 and a subsequent second level L2 higher than the first.

In an endeavour to obtain said flow-rate curve, it is known to provide injectors of a dedicated type, in which opening of the injection nozzle is caused by the lifting of two movable open/close pins co-operating with respective springs, or else by the lifting of a single movable open/close pin co-operating with two coaxial springs. In particular, the two springs are differently preloaded with respect to one another, and/or present characteristics of force/displacement that are different from one another, for opening the nozzle with lifts such as to approximate the required flow-rate curve.

The known solutions just described are far from altogether satisfactory in so far as it is somewhat complex to calibrate the springs in an optimal way to obtain a first level or step of flow rate smaller than the maximum flow rate from the nozzle and, hence, to approximate a flow-rate curve like the one of FIG. 1.

Furthermore, given the same pressure of supply of the fuel, once the law of lifting of the pins and, hence, the law of opening of the nozzle, has been established, the profile of flow rate of injected fuel is not modifiable as the operating conditions of the engine vary between the various injections performed by the injector.

In addition, it is somewhat difficult to obtain injectors with a profile of flow rate of injected fuel constant for the entire production.

The purpose of the present invention is to provide a method for controlling fuel injection in an internal-combustion engine which will enable the drawbacks set forth above to be overcome in a simple and economically advantageous way.

According to the present invention, a method is provided for controlling fuel injection in an internal-combustion engine provided with an electroinjector comprising:

an electroactuator; and an atomizer, comprising an injection nozzle and a pin, which is movable along an opening stroke and a closing stroke for opening/closing said nozzle under the control of said electroactuator; the electroinjector performing dosage of the fuel by modulating in time opening of the pin of the atomizer according to the pressure of supply of the electroinjector itself;

the method being characterized by supplying to said electroactuator a first electrical command and at least a second electrical command that are sufficiently close to one another as to displace said pin with a profile of motion without any discontinuity in time, and such as to cause said pin to perform a first opening displacement and a second opening displacement, respectively.

BRIEF DESCRIPTION OF THE DRAWINGS

For a better understanding of the present invention, there now follows a description of a preferred embodiment, which is provided purely by way of non-limiting example, with reference to the attached drawings, in which.

DETAILED DESCRIPTION OF THE DRAWINGS

Figure 1:
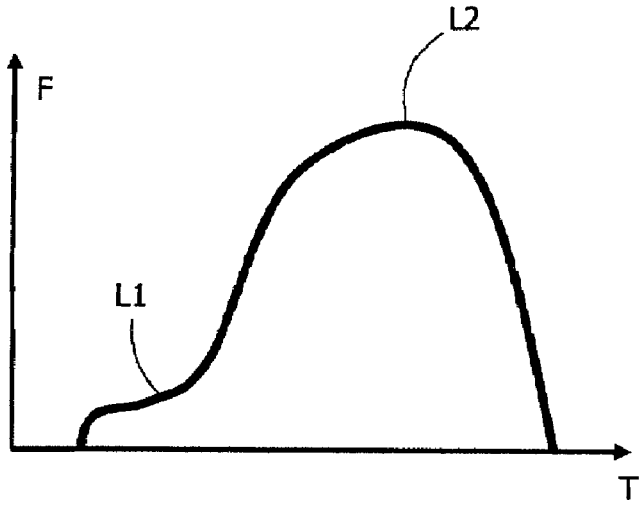
FIG. 1 shows a desired curve of instantaneous flow-rate of fuel as a function of time during one injection in an internal-combustion engine.

The electroinjector 1 comprises an external structure or shell 2, which extends along a longitudinal axis 3, has a side inlet 4 designed to be connected to a system (not illustrated) for supply of fuel, and ends with a atomizer.

The atomizer comprises a nozzle 5 communicating with the inlet 4 and designed to inject the fuel into a combustion chamber, and an open/close pin 7 or needle, which is movable along an opening stroke and a closing stroke for opening/closing the nozzle 5 under the control of an electrically controlled actuator device 8, or electroactuator. The electroinjector 1 carries out dosage of the fuel by modulating in time opening of the pin 7 of the atomizer according to the pressure of supply of the electroinjector 1 itself, i.e., of the pressure at the inlet 4, as will emerge more clearly from the ensuing description.

The device 8 is preferably of the type comprising: an electromagnet 10; an anchor 11, which is axially slidable in the shell 2 under the action of the electromagnet 10; and a pre-loaded spring 12, which is surrounded by the electromagnet 10 and exerts an action of thrust on the anchor 11 in a direction opposite to the attraction exerted by the electromagnet 10.

Figure 5:
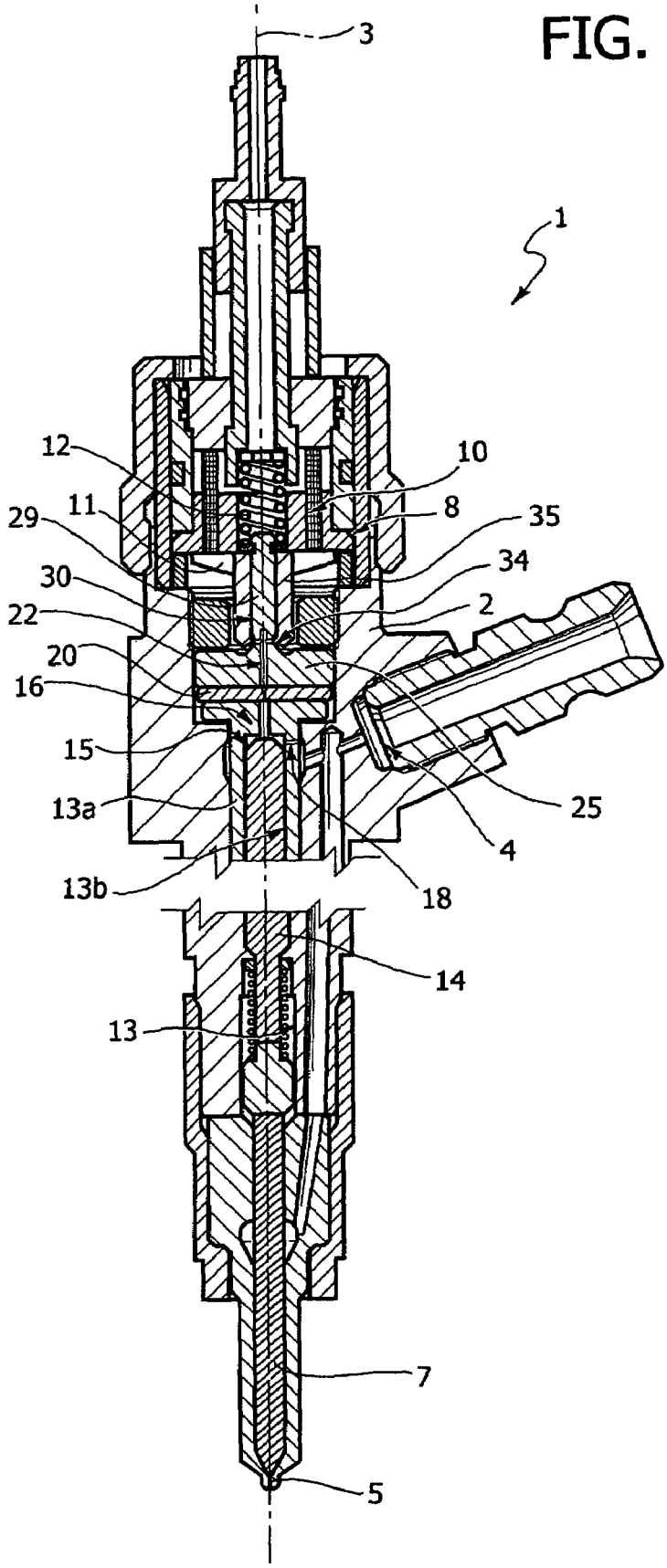
FIG. 5 shows, in cross section and with parts removed for reasons of clarity, an electroinjector for implementing the method of the present invention.

The shell 2 has an axial seat 13, which is illustrated with parts removed for reasons of clarity in FIG. 5 and is obtained as a prolongation of the seat in which the pin 7 slides. An intermediate stretch of the seat 13 houses a body 13*a* having the shape of a glass turned upside down (partially illustrated), which is coupled to the shell 2 in a fixed position and in a fluid-tight way and has an axial seat 13*b*. The seat 13*b* houses a rod 14, which is axially slidable in the seats 13*b* and 13 and transmits an action of thrust to the pin 7 along a closing stroke under the action of the pressure of the fuel present in a control chamber 15.

The chamber 15 constitutes the end portion of the seat 13*b*, defines part of a control servo-valve 16 and communicates permanently with the inlet 4 through a passage 18 made in the shell 2 and in the body 13*a* for receiving fuel under pressure, so that modulation of opening and closing of the pin 7 exerted by the rod 14 is performed according to the pressure of supply of the fuel into the electroinjector 1.

The chamber 15 is axially delimited, on one side, by the rod 14 and, on the other, by an end portion of the body 13*a*, to which there is then set axially alongside a disk 20, fixed with respect to the shell 2 by means of an appropriate clamping system.

The servo-valve 16 further comprises a passage 22, which defines the outlet of the chamber 15, is substantially symmetrical with respect to the axis 3 and is made in the body 13*a*, in the disk 20, and in a distribution body 25 set in an intermediate axial position between the disk 20 and the device 8. The body 25 is fixed with respect to the shell 2, is axially coupled in a fluid-tight way to the disk 20 so that it bears thereupon, and ends with a stem or pin 29 delimited by a cylindrical side surface 30, dug into which is an annular chamber 34 in which there gives out the passage 22.

The radial outlet of the passage 22, defined by the chamber 34, is designed to be opened/closed by an open/close element defined by a sleeve 35, which is fitted on the stem 29 and is axially slidable under the action of the device 8 for varying the pressure present in the chamber 15 and, hence, for opening/closing the nozzle 5.

It is evident that, when the sleeve 35 closes the chamber 34, it is subjected to a resultant of pressure that is zero along the axis 3 by the fuel, with consequent advantages from the standpoint of stability of dynamic behaviour of the movable parts of the injector 1.

In particular, displacement of the pin 7 along the opening stroke, i.e., during lifting, and along the closing stroke is practically constant between one injection and the next in response to a given electrical command sent to the device 8. In other words, it is possible to correlate in a biunique and repeatable manner the position of the pin 7 with the electrical commands supplied to the device 8. The position of the pin 7 along the opening and closing strokes in response to an electrical command can be known via theoretical calculation, as a function of constructional parameters of the injector 1 (for example sections of passage of the servo-valve 16) and as a function of known operating parameters (for example, pressure of supply of the fuel into the inlet 4), or else experimentally by means of a "sample" injector on which appropriate sensors are mounted. At the same time, the opening section of the nozzle 5 and, hence, the instantaneous flow-rate pattern of the fuel can be determined in a unique way as a function of the axial displacement of the pin 7, in particular on the basis of the dimensions of the passages of the nozzle 5 itself and on the basis of the pressure of supply of the fuel.

Figure 2:
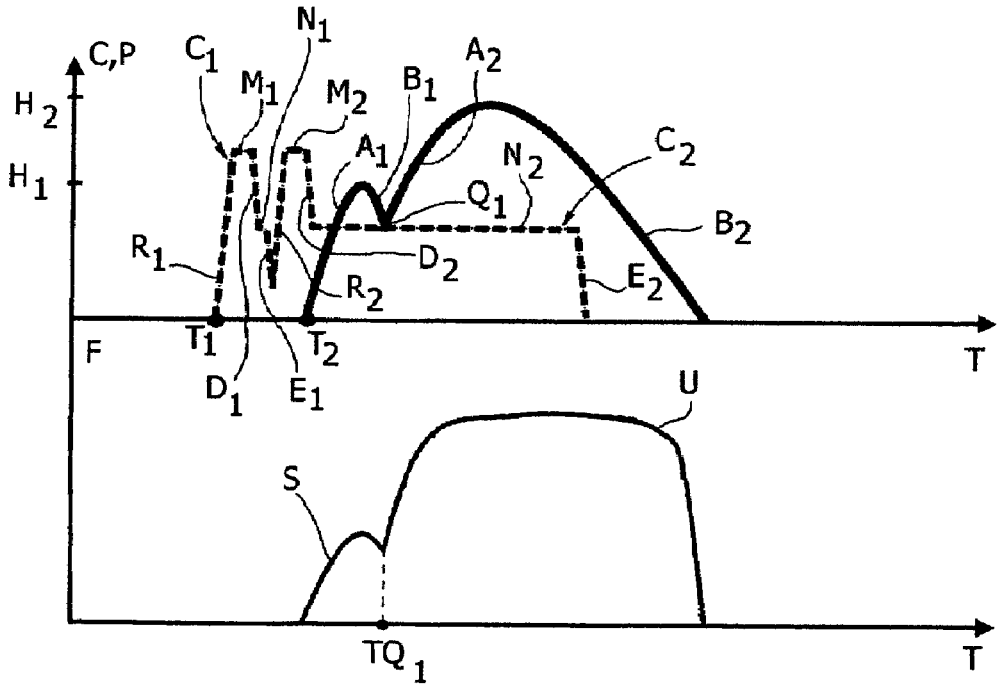
FIGS. 2 to 4 show graphs for operation of an electroinjector according to preferred embodiments of the method for controlling fuel injection in an internal-combustion engine of the present invention.
Figure 3:
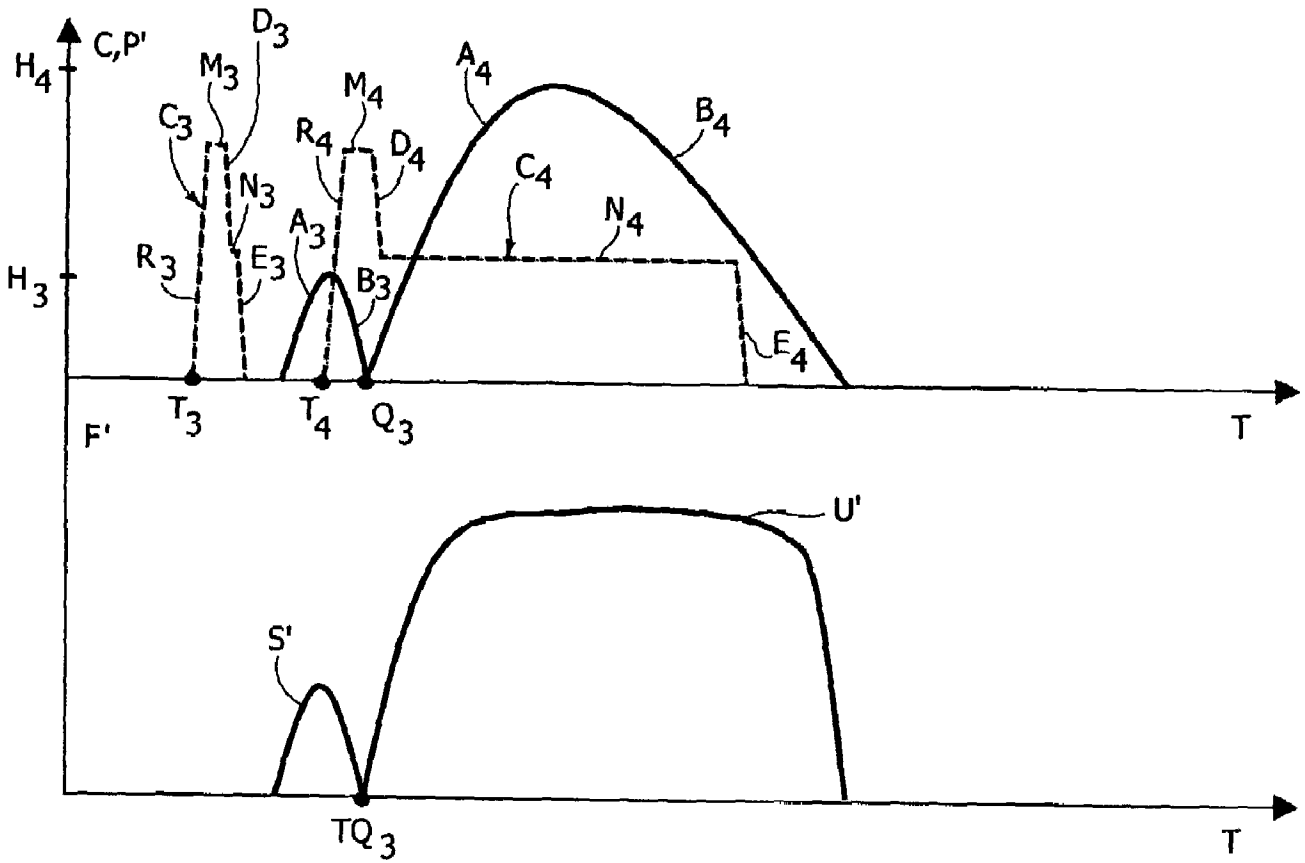
Figure 4:
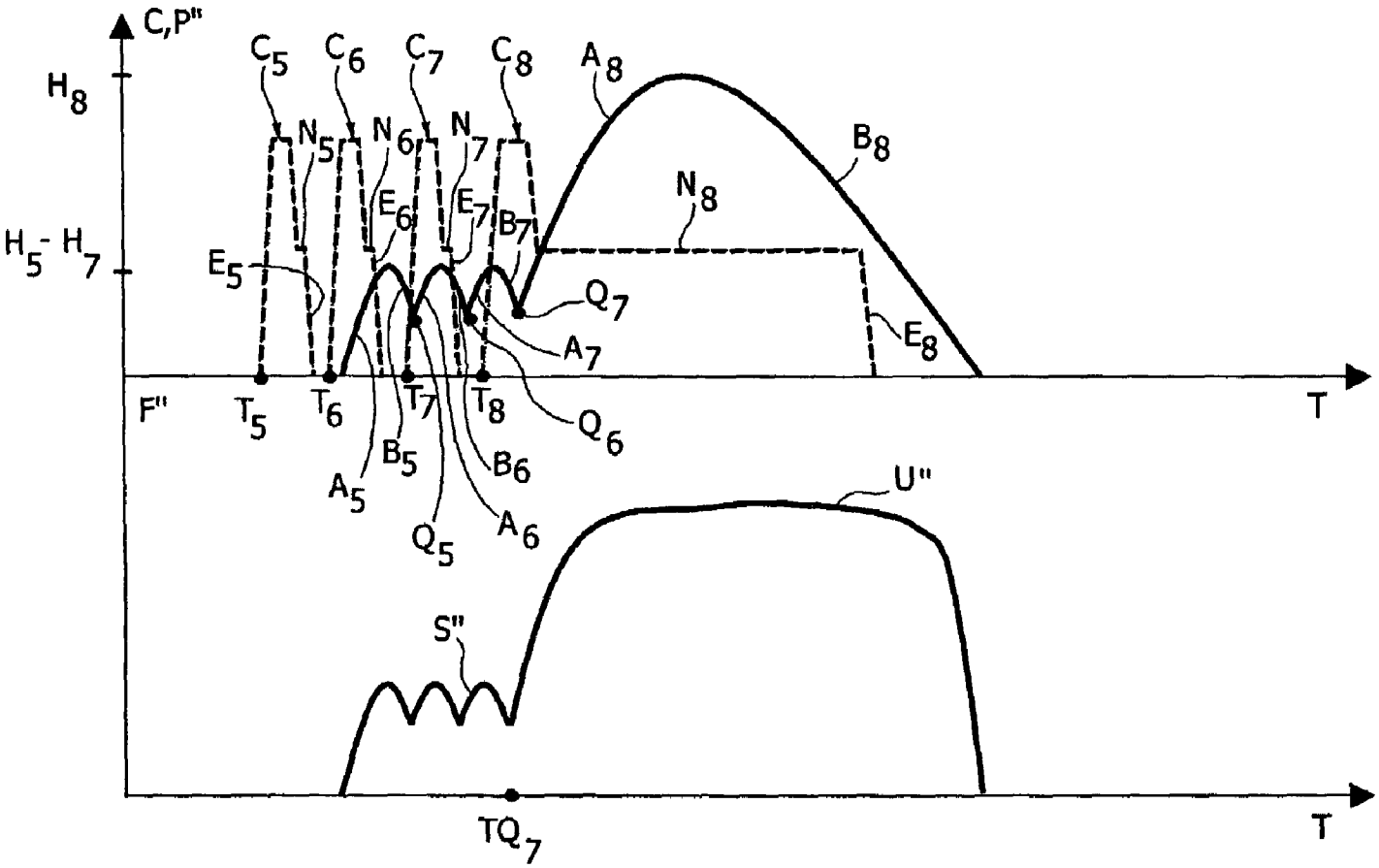

Each of FIGS. 2 to 4 illustrates: a corresponding top graph, which represents, as a function of time T, the waveforms C of the electrical commands supplied, according to the present invention, to the device 8 (dashed line) and the motion profile P of motion or plot of the axial position assumed by the pin 7 (solid line), in response to said commands, with respect to the ordinate "zero" in which the nozzle 5 is closed; and a corresponding bottom graph, which represents, as a function of time T, the curve F of the instantaneous flow rate of fuel (solid line) injected through the nozzle 5 and caused by the displacement of the pin 7 shown in the corresponding top graph.

In FIGS. 2–4, the commands are associated to respective reference numbers, which appear as subscripts near to the reference letters that designate the various parts of the corresponding graphs.

For reasons of clarity, by the term "command" is meant, in the present description and in the annexed claims, an electrical signal having a curve C that initially has a trailing edge or ramp with a relatively fast initial increase. In the particular examples illustrated, the device 8 receives signals of electric current, the curve C of which presents, after the trailing edge R, a stretch M of holding around a maximum value, a stretch D of decrease down to an intermediate value, a stretch N of holding around said intermediate value, and a stretch E of final decrease.

According to the method of the present invention, to obtain a fuel injection, supplied to the device 8 are a first electrical command and at least a second electrical command, which are sufficiently close to one another as to displace the pin 7 with a profile P of motion without any discontinuity in time and such as to cause the pin 7 to perform a first and, respectively, a second opening displacement, or lifts, which are defined in the profile P by respective stretches A, increase up to relative-maximum values H, and are followed by respective closing displacements defined by decreasing stretches B of the profile P.

With reference to the example of FIG. 2, at the instant $T_1$ there is supplied a first command, the curve $C_1$ of which increases with the ramp $R_1$, remains then substantially constant (stretch $M_1$), then decreases along the stretch $D_1$, has a substantially constant stretch (stretch $N_1$), and finally decreases (stretch $E_1$).

The curve $C_1$ causes displacement of the pin 7 with a profile P comprising the increasing stretch $A_1$, up to the value $H_1$, and the decreasing stretch $B_1$. A second command is supplied at an instant $T_2$ such as to start the second lift, i.e., the stretch $A_2$, in a point $Q_1$ of the stretch $B_1$, before the pin 7 has reached the position of end-of-closing stroke of the nozzle 5. In particular, the instant $T_2$ is smaller than the theoretical instant in which the first command represented by the curve $C_1$ would reach a zero value. The curve $C_2$ has a stretch $N_2$ of duration longer than the stretch $N_1$, so that the lift of the pin 7 reaches a value $H_2$ greater than $H_1$, causing a degree or section of opening of the nozzle 5 greater than that reached at the end of the stretch $A_1$.

There then follows a closing displacement defined by the stretch $B_2$ up to complete closing of the nozzle 5, after which the pin 7 remains stationary until the subsequent injection.

The curve F of the instantaneous flow rate obtained approximates in a satisfactory manner the desired curve of instantaneous flow rate illustrated in FIG. 1, in so far as it presents two consecutive portions S and U, which have respective maximum levels that are different from one another and respective mean levels that are different from one another and approximate the levels L1 and L2, respectively. It is evident that the instant in which the portion S ends and the portion U starts corresponds to the time abscissa of the point $Q_1$ ($TQ_1$).

According to the example of FIG. 3, the device 8 receives in succession two electrical commands, which are designated by the subscripts or reference numbers 3 and 4, respectively, and which cause the pin 7 to be displaced with a profile P' of motion (solid line) which is again without any discontinuity in time, i.e., without dwell times, between the stretch $B_3$ and the stretch $A_4$, but in a limit condition, i.e., supplying the second electrical command at an instant $T_4$ such as to start the second lift (stretch $A_4$) at a final point $Q_3$ of the stretch $B_3$, i.e., when the pin 7 has just reached the position of end-of-closing stroke. In particular, the instant $T_4$ is greater than the instant at which the stretch $E_3$ of the curve $C_3$ goes to zero. Albeit in a limit condition, the curve F' of instantaneous flow rate obtained comprises two consecutive portions S' and U', which have respective maximum levels that are different from one another and respective mean levels that are different from one another and approximate still in a satisfactory manner the levels L1 and L2, respectively, of the desired instantaneous-flow curve of FIG. 1. It is evident that the instant at which the portion S' ends and the portion U' starts corresponds to the time abscissa of the point $Q_3$ ($QT_3$).

According to the example of FIG. 3, the device 8 receives four electrical commands in succession, which are designated, respectively, by the reference numbers or subscripts 5–8, and are supplied in respective instants $T_5$–$T_8$ sufficiently close to one another as to displace the pin 7 with a profile P" of motion that is once again without any discontinuity in time. In particular, the instants $T_6$–$T_8$ are greater than the instants at which the stretches $E_5$–$E_7$, respectively, go to zero. In a way similar to the example of FIG. 2, the stretches $A_6$–$A_8$ start in respective points $Q_5$–$Q_7$ of the stretches $B_5$–$B_7$ in which the pin 7 has not yet reached the position of end-of-closing stroke of the nozzle 5.

The values $H_5$–$H_7$ (relative-maximum values) reached by the pin 7 at the end of the first three lifts are substantially equal to one another, so that the relative maximum opening sections of the nozzle 5 are substantially the same as one another. The value $H_8$ reached at the end of the fourth and last lift (stretch $A_8$) is greater and causes a greater degree or section of opening, in so far as the stretch $N_8$ has a duration longer than the stretches $N_5$–$N_7$.

There is consequently obtained a curve F" of flow rate which approximates the desired flow-rate curve of FIG. 1 in a better way, in so far as it approaches more closely a "stepwise" curve. In particular, the curve F" comprises, up to an instant $TQ_7$ coinciding with the abscissa of the point Q7, a portion S" which has three "peaks" and approximates the level L1 of the curve of FIG. 1 and, after the instant $TQ_7$, a portion U", which has mean and maximum levels greater than those of the portion S" and which approximates the level L2 of the curve of FIG. 1.

According to variants (not illustrated), it is possible to approximate curves of instantaneous flow rate of the "stepwise" type, in which there are present more than two levels, by causing the pin 7 to be displaced with more than two consecutive lifts up to values H that are different from one another, and/or to approximate curves of instantaneous flow rate, in which a level is followed by a lower level (instead of the levels L1 and L2 illustrated by way of example), by supplying electrical commands having appropriate durations and magnitudes.

Furthermore, according to the method of the present invention, for at least one injection, at least one of the following quantities is determined as a function of operating parameters of the engine:

- duration of at least one of the electrical commands to be supplied to the device 8;
- number of the electrical commands to be supplied to the device 8; and
- distance in time between the start of the electrical commands to be supplied to the device 8.

In particular, between one injection and the next, at least one among the following quantities is varied as a function of operating parameters of the engine, in particular as a function of the load:

- duration of at least one of the electrical commands;
- number of the electrical commands; and
- distance in time between the electrical commands.

In this way, it is possible to modulate the curve of the instantaneous flow rate between the various injections by varying the amplitude and/or duration and/or the number of the substantially constant levels of flow rate that it is desired to approximate.

From the foregoing description it is evident how it is possible to inject an instantaneous flow rate that approximates in an optimal manner flow-rate curves of the "stepwise" type and how this is obtained in a relatively simple way.

In fact, the control of injection according to the method described above does not require any calibration of mechanical components and/or injectors made in a dedicated manner.

Furthermore, the curve of the flow injected can be easily varied between one injection and the next so as to approximate as well as possible the desired flow-rate curve and optimize the efficiency of the engine according to the specific point of operation of the engine itself.

From the foregoing description, it is evident how the control method described can undergo modifications and variations that do not depart from the sphere of protection of the present invention.

In particular, the control method could be implemented with injectors that are different from the electroinjector 1 illustrated by way of example, but in which the displacement of the open/close pin of the nozzle is always performed as a function of the pressure of supply of the fuel and is repeatable in response to given electrical commands.

Furthermore, the device 8 could comprise a piezoelectric actuator, instead of an electromagnet.

Furthermore, the pin 7 could be displaced during lifting in one and the same injection for a number of times and/or by amounts different from those indicated by way of example.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A method for controlling fuel injection in an internal-combustion engine provided with an electroinjector comprising:

an electroactuator; and an atomizer, the atomizer comprising an injection nozzle and a pin, which is movable along an opening stroke and a closing stroke for opening/closing said nozzle under the control of said electroactuator; the electroinjector performing dosage of the fuel by modulating in time opening of the pin of the atomizer according to the pressure of supply of the electroinjector itself;

the method comprising the acts of: supplying to said electroactuator a first electrical command and at least a second electrical command that are sufficiently close to one another as to displace said pin with a profile of motion without any discontinuity in time, wherein said second electrical command is supplied before said first electrical command reaches zero; and causing said pin to perform a first opening displacement and a second opening displacement, respectively based on said supplied commands.

2. The method according to claim 1, wherein said second electrical command is supplied at an instant such as to start said second opening displacement when said pin is displacing along said closing stroke.

3. The method according to claim 1, wherein said first electrical command and second electrical command are supplied in such a way to reach, at the end of said first opening displacement and second opening displacement, a first degree of opening of said nozzle and, respectively, a second degree of opening of said nozzle, which are different from one another.

4. The method according to claim 3, wherein said first electrical command is supplied prior to said second electrical command, and in such a way that said second degree of opening ($H_2$) is greater than said first degree of opening.

5. The method according to claim 1, further comprising the act of supplying to said electroactuator at least a third electrical command sufficiently close to said first and second electrical commands as to displace said pin with a profile of motion, without any discontinuity in time and such as to cause said pin to perform a third open displacement in succession to said first and second opening displacements.

6. The method according to claim 5, wherein said first, second and third electrical commands are supplied in such a way as to cause, at the end of said first, second and third opening displacements, a first degree, a second degree and, respectively, a third degree of opening to be reached, and in such a way that said first and second degrees of opening are smaller than said third degree of opening.

7. The method according to claim 6, wherein said first and second electrical commands are supplied consecutively with respect to one another and prior to said third electrical command.

8. The method according to claim 6, said first and second electrical commands are supplied in such a way that said first and second degrees of opening are equal to one another.

9. The method according to claim 1, further comprising the acts of determining, for at least one injection, at least one among the following quantities as a function of operating parameters of said engine:

duration of at least one among said electrical commands;
number of said electrical commands; and
distance in time between said electrical commands.

10. The method according to claim 9, further comprising the act of varying, between one injection and the next, at least one among the following quantities as a function of operating parameters of said engine:

duration of at least one among said electrical commands;
number of said electrical commands;
distance in time between said electrical commands.

11. The method according to claim 7, wherein said first and second electrical commands are supplied in such a way that said first and second degrees of opening are equal to one another.

12. The method according to claim 5, further comprising the acts of determining, for at least one injection, at least one among the following quantities as a function of operating parameters of said engine:

duration of at least one among said electrical commands;
number of said electrical commands; and
distance in time between said electrical commands.

13. The method according to claim 9, further comprising the act of varying, between one injection and the next, at least one among the following quantities as a function of operating parameters of said engine:

duration of at least one among said electrical commands;
number of said electrical commands;
distance in time between said electrical commands.

14. The method according to claim 2, wherein said first electrical command and second electrical command are supplied in such a way to reach, at the end of said first opening displacement and second opening displacement, a first degree of opening of said nozzle and, respectively, a second degree of opening of said nozzle, which are different from one another.

15. A method for controlling fuel injection in an internal combustion engine having an electroinjector, the method comprising the acts of:

supplying to an electroactuator of the electroinjector a first electrical command and at least a second electrical command, wherein said second electrical command is supplied before said first electrical command reaches zero;

displacing a pin of an injection nozzle forming part of an atomizer of the electroinjector with a motion profile without any discontinuity in time based on the first and second electrical commands being sufficiently close to one another in time to control the pin displacement; and wherein said displacing act causes the pin to perform a first opening displacement and a second opening displacement, respectively.

* * * * *